US005928710A

United States Patent [19]

Busse et al.

[11] Patent Number: 5,928,710

[45] Date of Patent: Jul. 27, 1999

[54] ELECTRODE PROCESSING

[75] Inventors: Bernd Busse, Darmstadt; Robert A. Scannell, Pfungstadt; Georgios Ziogou, Alzenau, all of Germany

[73] Assignee: WCH Heraeus Elektrochemie GmbH, Rodenbach, Germany

[21] Appl. No.: 08/841,840

[22] Filed: May 5, 1997

[51] Int. Cl.[6] ..... B05D 3/06

[52] U.S. Cl. ..... 427/8; 427/58; 427/299; 427/314; 427/398.3; 427/557; 427/595

[58] Field of Search ..... 427/58, 299, 314, 427/398.3, 595, 8, 557

[56] References Cited

U.S. PATENT DOCUMENTS

| | | | |
|---|---|---|---|
| 3,674,676 | 7/1972 | Fogelman | 204/286 |
| 3,930,980 | 1/1976 | De Nora et al. | 204/286 |
| 3,980,545 | 9/1976 | De Lachaux et al. | 204/286 |
| 4,033,849 | 7/1977 | Pohto et al. | 204/286 |
| 4,154,667 | 5/1979 | Pohto et al. | 204/286 |
| 4,279,731 | 7/1981 | Pellegri | 204/254 |
| 4,343,689 | 8/1982 | De Nora et al. | 204/253 |
| 4,448,664 | 5/1984 | Ikegami et al. | 204/286 |
| 5,045,365 | 9/1991 | Okano et al. | 427/423 |
| 5,435,896 | 7/1995 | Hardee et al. | 204/247 |
| 5,593,555 | 1/1997 | Klatt et al. | 204/286 |

FOREIGN PATENT DOCUMENTS

| | | | |
|---|---|---|---|
| 0383243 | 8/1990 | European Pat. Off. | C25B 9/00 |
| 0611836 | 8/1994 | European Pat. Off. | C25B 9/00 |
| 2124257 | 2/1984 | United Kingdom | C25B 11/02 |

*Primary Examiner*—Bernard Pianalto
*Attorney, Agent, or Firm*—Fulbright & Jaworski, LLP

[57] ABSTRACT

Disclosed is an industrial technique for electrode processing for the direct recoating of an electrode surface for use in an electrochemical process wherein the recoating operation is performed without disassembly of the electrode assembly. In the process, a coating solution is applied to the electrode surface and a temperature differential is established, or induced, and maintained between the electrode surface and other components of the assembly while the coating is cured on the electrode surface.

31 Claims, 1 Drawing Sheet

ELECTRODE PROCESSING

BACKGROUND OF THE INVENTION

The present invention is in electrode processing and, more specifally, a process for recoating an electrode structure for an electrolysis cell and, in particular, for a chlor-alkali electrolysis cell by the diaphragm or membrane cell process with electrodes.

The process known as direct recoating of electrodes and, in particular, that for the chlor-alkali diaphragm process, uses a complex electrode structure consisting of a mesh welded to a substructure containing a Cu—Ti rod and involves recoating the electrode without disassembly during the process. The life of an electrocatalytic recoating is limited by electrochemical, chemical and mechanical wear of the coatings. The average lifetime of a coating can be 15 years. After this period, the coating must be renewed. The classical method for recoating is either to: a) detach the mesh, or b) attempt to thermally insulate the temperature-sensitive sections such as Cu—Ti rod Ni—Ti joints. The drawback with the former is the high cost involved and in the latter the insufficient protection for the temperature-sensitive sections especially in view of the repeated temperature cycles needed to obtain the desired coating thicknesses.

The current practice for the recoating of electrodes generally involves the repeated application of a coating solution to the electrodes followed by furnacing between each coating operation. This process is satisfactory if the electrodes are made exclusively of a single metal, usually titanium. If, however, the electrode or its components are made from one or more metals, the resulting temperature variations can induce stresses at the interfaces between the dissmilar metals within the rod. The developing stresses can be of a sufficient magnitude to cause disruption of the bonds between the metals resulting in delamination. Such a delamination adversely effects the performance of the recoated electrode structure.

SUMMARY OF THE INVENTION

The present invention is in a process for direct recoating of an electrode for an electrochemical process wherein the electrode assembly is not disassembled during the recoating procedure.

In the process of the invention, the electrode surfaces to be coated are heated to the appropriate process temperatures while other components of the assembly are maintained at lower temperatures. In general, there is a thermal differential applied to, or induced in, different components of the electrode assembly. More specifically, the metal surfaces to be coated are heated while the bimetallic components, such as the copper/titanium rods, are maintained at lower temperatures. This may be accomplished by cooling and/or by the use of cooling devices inserted during the coating process.

In one embodiment, the electrode surface being coated is heated by the use of infrared ("IR") heat. The infra-red energy heats the area to be coated and a by virtue of its high capture of the IR radiation, the heat is concentrated on the mesh because of its greater surface area compared to that of the conductor bar. The heat energy is substantially retained on the mesh because of the relatively poor thermal conductivity of the titanium mesh. Thus, any technique that enables effective differential heating of the mesh and uses its relatively poor thermal conductivity can be used in the invention.

Other components of the electrode assembly, such as the rod are maintained at, or cooled to, a lower temperature. The selective cooling of the temperature-sensitive sections of the electrode is preferably by means of a forced flow of fluid (gaseous or liquid) about the sections to be cooled. The selective forced cooling is preferably achieved in an oven wherein the heat is supplied to the electrode by one or more infra-red heat lamps which allows a rapid and controlled heating phase of the coated surfaces.

In another embodiment of the invention, one or more surface temperature measuring devices which enable an accurate temperature profile to be imposed on the mesh are employed.

In another embodiment of the invention, one or more inserts are positioned in the inner section of the electrode to act as a flow guide for the cooling medium during the selective heating and cooling. The inserts may be heat reflecting or non-heat reflecting depending on the need to heat or cool certain sections of the electrode.

The process of the invention prevents the delaminating of the copper/titanium components during the coating operation. Surprisingly, the process of the invention results in a higher quality product which enables one to employ lower operating voltages while obtaining improved current distribution in the electrolysis cells. Process cost reductions may also be achieved.

The various features of novelty which characterizes the invention are pointed out with particularity in the claims annexed to and forming a part of this specification. For a better understanding of the invention, its operating advantages and specific objects obtained by its use, reference should be made to the accompanying drawings and descriptive matter in which there is illustrated and described a preferred embodiment of the invention.

DESCRIPTION OF PREFERRED EMBODIMENT

The present invention is in a coating and/or recoating process for an electrode surface wherein a temperature differential is applied to, or induced in, component parts of an electrode assembly of which an electrode surface is a component. The process of the invention enables the electrode surface to be coated without disassembling the electrode assembly.

U.S. Pat. No. 5,593,555, the dislcosure of which is incorporated herein by reference, generally illustrates an electrode structure of the general type to which the process of the invention can be applied.

Figure 1:
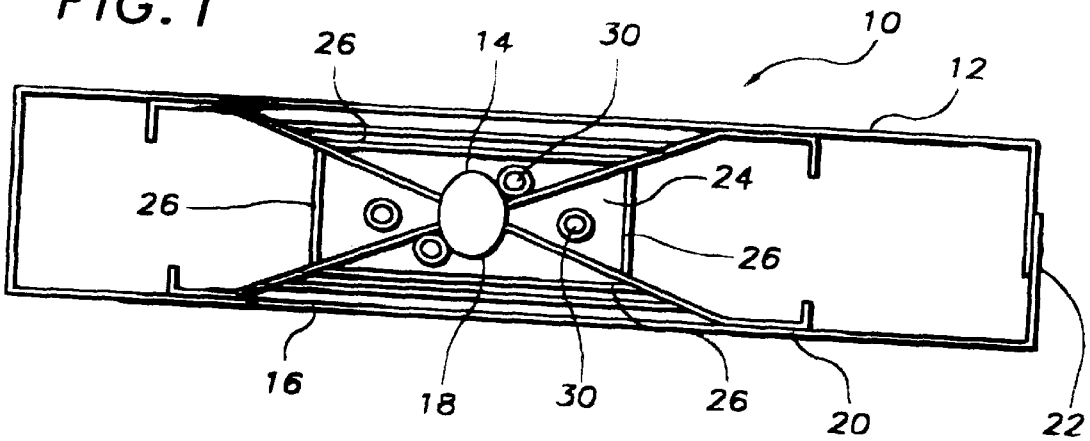
FIG. 1 generally depicts, in plan view, an electrode assembly to which the process of the invention can be applied.

FIG. 1 generally depicts, in plan view, an electrode assembly 10. Electrode assembly 10 is a spring type electrode assembly and is shown in its expanded state. The electrode assembly 10 is formed of an outer mesh 12 which is an active electrode surface, a main power feed 14, which has an electrically conductive bar of a Cu—Ti alloy or Cu sheathed in Ti, and a feed conductor assembly 16. The feed conductor assembly 16 is welded to the rod 14 at joints 18 which are Cu—Ti joints. As shown in FIG. 1, the mesh 12 is welded to the feed conductor assembly 16 at a plurality of locations 20, only one of which is depicted and designated in the drawings. The mesh 12 is flexible and, on at least one end thereof, can have an overlapping area 22. Generally, the electrode will be of titanium but the electrode may be of another material such as nickel.

In a preferred embodiment, a cooling chamber 24 is formed in, or positioned in, the electrode assembly 10. The chamber 24 may be a unitary structure, or be defined by a plurality of inserts 26 which are preferably constructed of titanium. The chamber 24 may be in the form of a sleeve of any geometric shape with cut-out channels or slots allowing the sleeve to be slipped over the component parts of the assembly so as to at least partially surround the rod 14.

The inserts 26 are positioned to extend between the members of the conductor assembly so as to form a box-like chamber surrounding the rod 14. The inserts, like the chamber or sleeve, may be heat reflecting or non-heat reflecting and preferably extend parallel to the rod 14 for at least a fraction, but preferably substantially the full length of the rod. The inserts are preferably of titanium and are dimensioned so as to be secured in position by a friction or tight fit and/or by the use of conventional clips. Titanium is a heat reflecting material. However, the titanium may have a black oxide coating which could render it non-heat reflecting.

Figure 2:
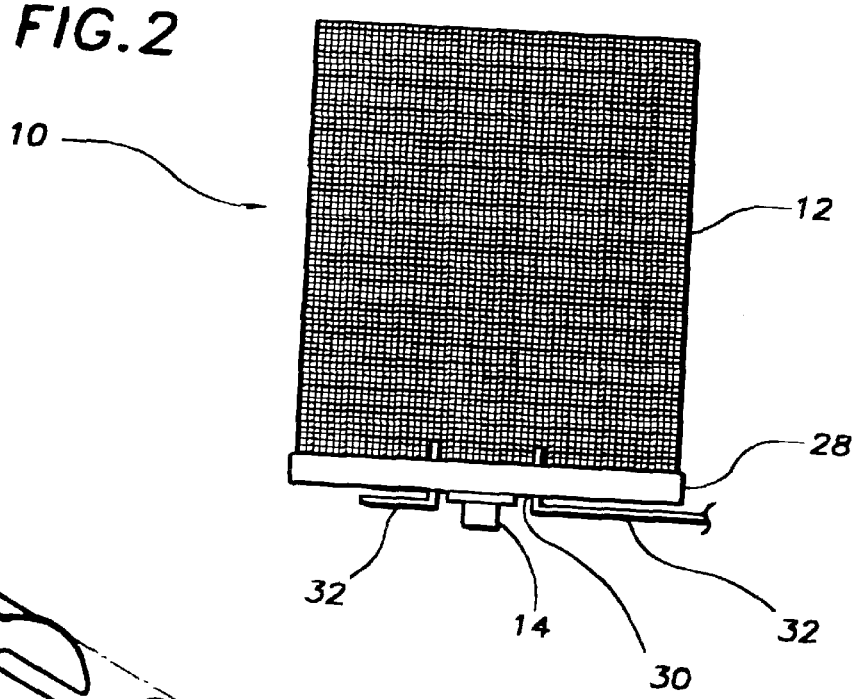
FIG. 2 shows a side view of the electrode assembly of FIG. 1.

FIG. 2 shows a side view of the electrode assembly 10 which can be coated by the process of the invention. The electrode assembly 10 is mounted on a base plate 28 through which rod 14 extends. The mesh 12 is more clearly illustrated in FIG. 2. The base plate 28 is formed with at least one, and preferably a plurality of, entry ports 30 through which a cooling fluid such as a liquid or gas can be introduced by lines 32. The ports 30 preferably surround the rod 14 as shown in FIG. 1 and are positioned so tht the fluid passing therethrough will be contained within chamber 24 or the area defined by the inserts 26.

In another embodiment of the invention, the Cu—Ti rod is hollow and a liquid medium can be used as a cooling fluid. The cooling liquid may be water or may be a water-ethylene glycol mixture or a commercial cooling fluid such as Dow-Therm. In this embodiment, the rod is cooled from the inside by forcing the cooling fluid through the inside of the rod by means of a pipe. The cooling fluid is then removed through the bottom. The rod remains below 50° C. even when the mesh is at 500° C. for 10 minutes.

In the process of the invention, the electrode assembly 10, an expandable type of electrode is preferably in an expanded state. The sections of the electrode assembly 10 to be coated are pre-treated where necessary, i.e., by an etching, and the coating solution is applied to the electrode surfaces. The coating solution can be of the so-called mixed metal oxide type coating, for example, the classical Beer-type coatings and their subsequent modifications including the full range of mixed metal oxide coatings, e.g., mixed metal oxides of Ru, Ir, Sn, Ti, Rh, and Ta. A preferred coating solution is the $RuCl_3$—$T_1Cl_3$ coating solution.

In a preferred embodiment, the electrode assembly 10 with the electrode surface coated is placed in an infra-red oven containing infra-red heat lamps. A suitable heating oven is available from Heraeus Nodlelight GmbH of Kleinostheim, Germany. The electrode assembly 10 need not be disassembled and can be positioned on a cart and rolled into, and out of, the oven along a track. The electrode assembly is positioned and secured such that the infra-red heat is primarily focused on the coated electrode surface or surfaces. As a function of the coating solution, energy is supplied so as to raise the temperature of the electrode surface to about 45° to 520° C. The surface temperature is maintained for a period of about 5 to 10 minutes. A cooling fluid, which is preferably gaseous and most preferably air, is at a cool temperature relative to the temperature of the electrode defined by the mesh 12 and is caused to flow about and preferably parallel to the longitudinal axis of the rod 14. The flow path of the fluid is defined by the chamber 24 and/or the inserts 26.

The cooling fluid is preferably air but may be, or contain, boil-off from liquid nitrogen or dry ice.

In a preferred embodiment, the flow of cooling fluid may be controlled and is retained by the chamber 24 or the use of flow inserts 26. The cooling fluid is introduced into chamber 24 at a temperature of about 0 to 30° C. and preferably 10 to 20° C. at a flow rate of about 100 to 500 liters per minute (lpm) and preferably about 200 to 300 lpm. The flow of cooling fluid is maintained for a period in excess of the heat treatment period. Generally an additional period of the order of about 10 minutes is recommended to avoid, or minimize, any heat transfer from the heated mesh to the cooled rod. A temperature differential ($\Delta T$) between the electrode surface(s) and the rod surface of about 400 to 600° C., is established. Preferably, the temperature differential is pre-determined and maintained at a substantially constant value. The temperature differential is defined by the required coating temperature and the cooling achieved. Preferably, the rod remains at a temperature of less than about 100° C. The procedure is repeated with subsequent applications of the coating solution until the specified coating thickness on the electrode surface(s) is obtained.

In another embodiment of the invention, one or more temperature measuring devices, such as optical thermosensors, are focused on the electrode surface and the temperatures of the respective components of the assembly are measured. The rod temperature may be detected by means of a thermocouple. Optionally, the temperatures can be controlled automatically or manually by adjusting the infra-red energy output and/or the coolant flow rate. A further option is to control the temperature of the cooling fluid.

In a preferred embodiment, the temperature of the electrode is measured with optical thermosensors and the heating energy of the oven or lamps is controlled by a direct feedback system to a power controller. Optionally, the measurement can be used as a basis for a feed-forward control system for the cooling fluid. Alternatively, the temperature of the rod can be directly measured and that direct measurement can provide the basis for a feedback regulation of the cooling fluid.

The cooling fluid can be supplied by a blower or pump and is at a flow rate and/or flow condition so as to cool the rod and/or other components and maintain them within the desired temperature range and/or the desired temperature differential.

The cooling fluid is forced into the chamber or space defined by the inserts at a pressure of up to about 6 Bars. However, with the exception of the embodiment wherein the rod is hollow, the inserts in the electrode structure used to guide the coolant are simply slotted and have a large exit at one end thereof, preferably at the top. Therefore, the resulting air pressure may be slightly above atmospheric. In the case of the hollow rod, the pressure of the coolant is preferably slightly less than about 6 Bars.

Figure 3:
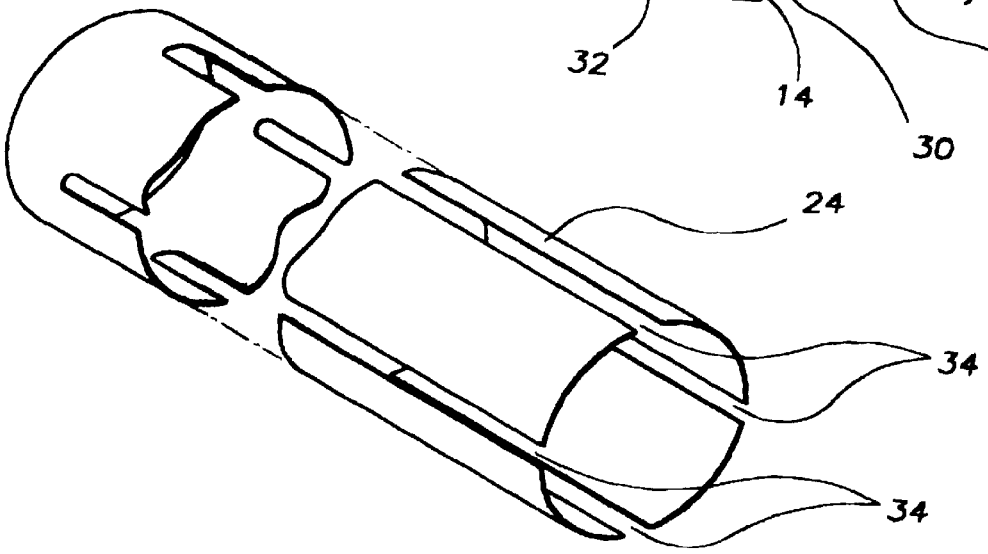
FIG. 3 shows, in perspective, a sleeve structure useful in the process of the invention.

FIG. 3 shows a perspective view of a chamber or sleeve 24 which may be used in the invention. The chamber may be of a rectangular construction. However, the chamber or sleeve could have other geometrical configurations. The chamber is formed of a plurality of walls or as a cylinder. Each of the walls has an elongated slot. As shown in FIG. 3, when the chamber or sleeve is cylindrical, it has a plurality of slots 34 which extend substantially the entire length of the chamber or sleeve. The sleeve or chamber is slipped onto the electrode or the inserts are positioned prior to the electrode being introduced into the oven. The sleeve should be of sufficient dimension to slip onto the electrode so as to surround and define an annular chamber around rod 14. The slots are shaped, positioned, and sized, to slide over the electrodes and to provide a snug fit therewith to minimize fluid leakage from the chamber surrounding rod 14.

Because a thermal gradient is established, there is a possibility of some deformation. To straighten the electrode by the usual methods such as hammering or bending is time-consuming. In another aspect of the invention, one or more notches is pressed along the full length of the electrode to a depth defined by the amount of distortion caused by the recoating process which is usually less than 10 mm to counteract the distortion.

EXAMPLE 1

An electrode assembly, as shown in FIGS. 1 and 2 for the generation of chlorine using the diaphragm process, was prepared with the classical method of cleaning the surface prior to recoating by etching in 15% hydrochloric acid at 80° C. for 10 minutes. The electrode was coated with a classical coating solution, a $RuCl_3$—$TiCl_3$ solution in diluted HCl. The electrode assembly was then mounted in the infra-red oven and fitted with inserts to channel and maintain a flow of cool air along the middle Cu—Ti rod. Four thermocouples were positioned evenly along the Cu—Ti rod. An IR temperature thermosensor measuring device (Impac Type IR 15) was positioned and secured so as to measure the temperature of the mesh. This device acted as the control for 2 banks of IR lamps, each bank having 6 lamps and each lamp having a power of 3000 W. Cool air at room temeprature, about 15° C., was forced through the middle of the electrode assembly at a flow rate of about 250 lpm. The temperatures of the mesh and the Cu—Ti rod were recorded as the mesh was heated to 530° C. and maintained for about 15 minutes. The temperature of the Cu—Ti rod was maintained at less than 80° C. The electrode was then removed from the oven and the mesh was allowed to cool to room temperature. The electrode was then recoated and the procedure was repeated 8 times until the desired coating thickness of about 10 g $Ru/m^2$ was obtained. The resistance of the rod was determined using a 4-point measurement wherein a current of 1000 A was fed in and out of the structure at two defined points and the voltage drop caused by the current is measured between two other points thus avoiding the measurement of contact resistance at the locations of entry and exit of the current. The resistance of the rod was about 40 mOhm.

EXAMPLE 2 (COMPARATIVE)

A similar electrode, as in Example 1, was prepared for coating in the same fashion as in Example 1. The thermocouples were attached as in Example 1 and placed in a conventional hot air oven. The oven temperature was then raised to 530° C. and held for 15 minutes so as to ensure the complete conversion of the chloride precursors to the electrochemical stable oxides. The temperature of the Cu—Ti rod was almost identical to that of the mesh and reached 500° C. within 2 minutes and remained at 500° C. for the course of the temperature treatment of the mesh. The resistance of the rod was determined using a 4-point measurement with 1000 A and was found to be about 120 mOhm, tripled in comparison to a similar measurement prior to coating and where the value of 40 mOhm was measured.

EXAMPLE 3 (COMPARATIVE)

A similar electrode, as in Example 1, was prepared for coating in the same fashion as given in Example 1. The thermocouples were attached as in Example 1 and placed in a conventional hot air oven. The Ti insert was filled with thermal insulating material from the M. Wolle company and was placed around the Cu—Ti. The oven temperature was then raised to 500° C. and maintained for 15 minutes so as to ensure the complete conversion of the chloride precursors to the electrochemical stable oxides. The temperature of the Cu—Ti rod reached 250° C. within 5 minutes and remained at between 250 and 300° C. for the course of the temperature treatment of the mesh. The treatment was repeated until the desired coating thickness of 10 g $Ru/m^2$ was obtained. The resistance of the rod as determined using a 4-point measurement with 1000 A was found to be about 90 mOhm, tripled in comparison to a similar measurement prior to coating and where the value of 40 mOhm was measured.

EXAMPLE 4

An electrode assembly, as shown in the Figures, for the generation of chlorine gas in the diaphragm process, was prepared with the classical method of cleaning the surface prior to recoating by etching with 15% hydrochloric acid at 80° C. for 10 minutes. The electrode surface is coated with a $RuCl_3$—$TiCl_3$ solution in dilute HCl which is a classical coating solution. The electrode was then mounted in an infra-red oven and fitted with the inserts to channel and maintain a flow of cool air along the middle Cu—Ti rod. Four thermocouples were positioned evenly along the Cu—Ti rod. An IR temperature measuring device from the Impac company was positioned and secured so as to be focused and, thus, measure the temperature of the mesh. This device acted as a control for 2 banks of IR lamps, each bank containing 6 lamps with each lamp having a power of 3000 W. Room temperature air was forced through the middle of the electrode body at a flow rate of about 250 lpm. The temperature of the mesh and that of the Cu—Ti rod were recorded as the mesh was heated to 530° C. and maintained at that temperature for 15 minutes. The temperature of the Cu—Ti rod was maintained at less than 80° C. The electrode was then removed from the oven and the mesh was allowed to cool to room temperature. The electrode was then recoated and the procedure was repeated until the desired coating thickness of about 10 g $Ru/m^2$ was obtained. The resistance of the rod was determined using a 4-point measurement with 1000 A and was about 40 mohm. Despite the fact that the electrode had an expected resistance, a marked deformation was found in contrast to Example 1. This may have been due to stress within the electrode structure prior to coating. Straightening was achieved by pressing a dent into the surface of the electrode. This had the added advantage that the spring sections of the anode were renewed in their resilient characteristic due to the tension brought back into the electrode following the pressing of the dent.

The terms and expressions which have been employed are used as terms of description and not of limitation, and there is no intention in the use of such terms and expressions of excluding any equivalents of the features shown and described or portions thereof; it being recognized that various modifications are possible within the scope of the invention.

We claim:

1. A process for restoring a coating in an electrode assembly having an electrode surface supporting the coating and an electrically conductive rod, said process comprising:

applying a coating solution to the electrode surface; and establishing and substantially maintaining a thermal differential between the electrode surface and the conductive rod while curing the coating solution on the electrode surface wherein the thermal differential is established by heating the electrode surface during the coating process and simultaneously force-cooling the conductive rod.

2. The process of claim 1 wherein the heating is by infra-red heating.

3. The process of claim 2 wherein the cooling is by a fluid flow.

4. The process of claim 3 wherein the fluid is air.

5. The process of claim 3 wherein the electrode assembly includes one or more ports through which the cooling fluid is introduced.

6. The process of claim 3 wherein the rod is hollow and the cooling fluid flows through the rod.

7. The process of claim 6 wherein the cooling is by a fluid which optionally is a liquid.

8. The process of claim 7 wherein the liquid is selected from the group consisting of water, ethylene glycol, commercial cooling fluid, and mixtures thereof.

9. The process of claim 2 wherein the infra-red heating is provided by heat lamps.

10. The process of claim 1 wherein the forced cooling fluid is directed to, and retained in, a defined area within the electrode assembly.

11. The process of claim 10 wherein the defined area is a chamber.

12. The process of claim 11 wherein the chamber surrounds the rod and extends for at least a fraction of the rod length.

13. The process of claim 10 wherein the defined area is one or more inserts.

14. The process of claim 13 wherein the one or more inserts is non-heat reflecting.

15. The process of claim 13 wherein the one or more inserts is heat reflecting.

16. The process of claim 13 wherein the inserts are of titanium.

17. The process of claim 1 further comprising measuring the temperature of the surface of the electrode by an IR-detector and controlling the heat input based on a signal from the IR detector.

18. The process of claim 1 wherein the forced cooling is convective cooling.

19. The process of claim 1 wherein the coating solution is based on a mixed metal oxide.

20. The process of claim 19 wherein the mixed metal oxide is an oxide of at least one of Ru, Ir, Sn, Ti, Rh, and Ta.

21. The process of claim 1 wherein the coating solution comprises $RuCl_3$—$TiCl_3$.

22. The process of claim 1 wherein the electrode is deformed, the process further comprising straightening of the deformed electrode by pressing a defined dent into the uneven surface so as to release the stress and allow the straightening of the surface.

23. A method of retarding delamination of a Cu—Ti rod of an electrode assembly comprising an electrode and a Cu—Ti rod during a recoating procedure, the method comprising force-cooling the rod during the heating of the electrode.

24. A process for restoring a coating in an electrode assembly having an electrode surface supporting the coating supported adjacent an electrically conductive rod with a laminated construction and having an outer surface portion comprising titanium material over an inner structure of a different material, said process comprising:

contacting the electrode surface with a coating solution;

curing the coating solution on the electrode surface; and heating the electrode surface and cooling the conductive rod during said curing so as establish and maintain a thermal differential between the electrode surface and the conductive rod while curing the coating solution on the electrode surface such that the conductive rod is kept at a low enough temperature to substantially prevent delamination of said outer surface portion from the inner structure of said rod during the curing of said electrode surface.

25. The process of claim 24 wherein the inner structure of the rod comprises copper material.

26. The process of claim 24 wherein the heating is by infra-red heating.

27. The process of claim 24 wherein the cooling is by a fluid flow contacting the conductive rod.

28. The process of claim 27 wherein the cooling fluid is directed to, and retained in, a chamber within the electrode assembly.

29. The process of claim 28 wherein the chamber surrounds the rod and extends for at least a fraction of the rod length.

30. The process of claim 24 wherein the rod is hollow and cooling fluid flows through the rod.

31. The process of claim 24 further comprising measuring the temperature of the electrode surface by an IR-detector and controlling the heating based on a signal from the IR detector.

* * * * *